US009574467B2

(12) United States Patent
Ha

(10) Patent No.: US 9,574,467 B2
(45) Date of Patent: Feb. 21, 2017

(54) CONTINUOUS VARIABLE VALVE DURATION APPARATUS

(71) Applicant: Hyundai Motor Company, Seoul (KR)

(72) Inventor: Kyoung Pyo Ha, Seoul (KR)

(73) Assignee: Hyundai Motor Company, Seoul (KR)

( * ) Notice: Subject to any disclaimer, the term of this patent is extended or adjusted under 35 U.S.C. 154(b) by 108 days.

(21) Appl. No.: 14/517,724

(22) Filed: Oct. 17, 2014

(65) Prior Publication Data

US 2015/0167509 A1 Jun. 18, 2015

(30) Foreign Application Priority Data

Dec. 18, 2013 (KR) ..... 10-2013-0158582

(51) Int. Cl.
*F01L 1/34* (2006.01)
*F01L 13/00* (2006.01)

(52) U.S. Cl.
CPC .... *F01L 13/0015* (2013.01); *F01L 2013/0084* (2013.01)

(58) Field of Classification Search
CPC ..... F01L 13/0015; F01L 2013/0084
USPC ..... 123/90.16, 90.6, 90.17, 90.39, 90.44
See application file for complete search history.

(56) References Cited

U.S. PATENT DOCUMENTS 4,131,096 A 12/1978 Mitchell
5,333,579 A 8/1994 Hara et al.
5,365,896 A 11/1994 Hara et al.
5,494,009 A 2/1996 Yamada et al.
5,553,573 A 9/1996 Hara et al.
5,557,983 A 9/1996 Hara et al.
5,592,908 A 1/1997 Hara et al.
5,622,144 A 4/1997 Nakamura et al.
5,636,603 A 6/1997 Nakamura et al.
5,687,681 A 11/1997 Hara
5,709,179 A 1/1998 Hara et al.
5,778,840 A 7/1998 Murata et al.
5,924,334 A 7/1999 Hara et al.
6,401,675 B1 6/2002 Nakamura et al.
6,425,357 B2 7/2002 Shimizu et al.
6,427,653 B1 8/2002 Hara et al.
6,874,456 B2 4/2005 Yamada et al.
6,907,852 B2 6/2005 Schleusener et al.

FOREIGN PATENT DOCUMENTS

DE 10306154 A1 * 8/2004 ..... F01L 1/022
JP 3198772 B2 8/2001

* cited by examiner

*Primary Examiner* — Ching Chang
(74) *Attorney, Agent, or Firm* — Morgan, Lewis & Bockius LLP

(57) ABSTRACT

A continuous variable valve duration apparatus may include a cam rotatably mounted on a cam carrier, a camshaft disposed within the cam and relatively rotatable with respect to the cam, in which a rotation center of the camshaft is variable with respect to a rotation center of the cam, a connecting link disposed between the cam and the camshaft, in which the connecting link is pivotally connected to at least one of the cam and the camshaft, and transmits rotation of the camshaft to the cam, and a control portion selectively changing the rotation center of the camshaft.

13 Claims, 8 Drawing Sheets

CONTINUOUS VARIABLE VALVE DURATION APPARATUS

CROSS-REFERENCE TO RELATED APPLICATION

The present application claims priority to and the benefit of Korean Patent Application No. 10-2013-0158582 filed Dec. 18, 2013, the entire contents of which is incorporated herein for all purposes by this reference.

BACKGROUND OF THE INVENTION

Field of the Invention

The present invention relates to a continuous variable valve duration apparatus. More particularly, the present invention relates to a continuous variable valve duration apparatus which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuously variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve duration apparatus which may vary opening duration of a valve according to operation conditions of an engine, with a simple construction.

According to various aspects of the present invention, a continuous variable valve duration apparatus may include a cam rotatably mounted to a cam carrier, a camshaft disposed within the cam and relatively rotatable with respect to the cam, and of which a rotation center of the camshaft is variable with respect to a rotation center of the cam, a connecting link disposed between the cam and the camshaft, and pivotally connected to at least one of the cam and the camshaft, and transmitting rotation of the camshaft to the cam, and a control portion selectively changing the rotation center of the camshaft.

The control portion may include a guide plate and a control plate including a camshaft bearing to which the camshaft is rotatably connected, wherein the control plate may selectively move along the guide plate.

A cam support may be formed to the cam as a cylinder and the guide plate may be connected to the cam carrier, and the cam support may be connected between the cam carrier and the guide plate through a cam bearing.

A guide pin may be formed on either of the control plate or the guide plate, and a guide rail guiding the guide pin may be formed on either of the control plate or the guide plate.

The control portion may further include a control shaft which is parallel to the camshaft and an eccentric cam mounted to the control shaft, in which a control slot may be formed on the control plate for the eccentric cam to be inserted thereto, and a relative position of the control plate with respect to the guide plate is changeable according to rotation of the control shaft.

The guide plate may be connected to the cam carrier, and the control shaft may be mounted between the guide plate and the cam carrier through a control shaft bearing.

A guide hole may be formed on the cam, and one end of the connecting link may be fixed to the camshaft, and a pivot head may be formed on another end of the connecting link, and the pivot head may be pivotally and slidably inserted into the guide hole.

A guide hole may be formed on the camshaft, and one end of the connecting link may be fixed to the cam, and a pivot head may be formed on another end of the connecting link, and the pivot head may be pivotally and slidably inserted into the guide hole.

Pivot holes may be formed on the camshaft and the cam respectively, and pivot heads may be formed on both ends of the connecting link and each pivot head may be pivotally inserted into corresponding pivot holes.

A pivot hole may be formed on the cam, a pivot cap, on which a pivot hole is formed, may be connected to the camshaft, and pivot heads may be formed to both ends of the connecting link and each pivot head may be pivotally inserted into corresponding pivot holes.

A guide slot may be formed on the cam, a pivot hole may be formed on the camshaft, and one end of the connecting link may be slidably inserted into the guide slot, and a pivot head may be formed on another end of the connecting link, and the pivot head may be pivotally inserted into the pivot hole.

A guide slot may be formed on the cam, a pivot cap, on which a pivot hole is formed, may be connected to the camshaft, and one end of the connecting link may be slidably inserted into the guide slot, and a pivot head may be formed on another end of the connecting link, and the pivot head may be pivotally inserted into the pivot hole.

A guide slot may be formed on the camshaft, a pivot cap on which a pivot hole is formed thereto, may be slidably inserted into the guide slot, and one end of the connecting link may be fixed to the cam, and a pivot head may be formed on another end of the connecting link, and the pivot head may be pivotally inserted into the pivot hole.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
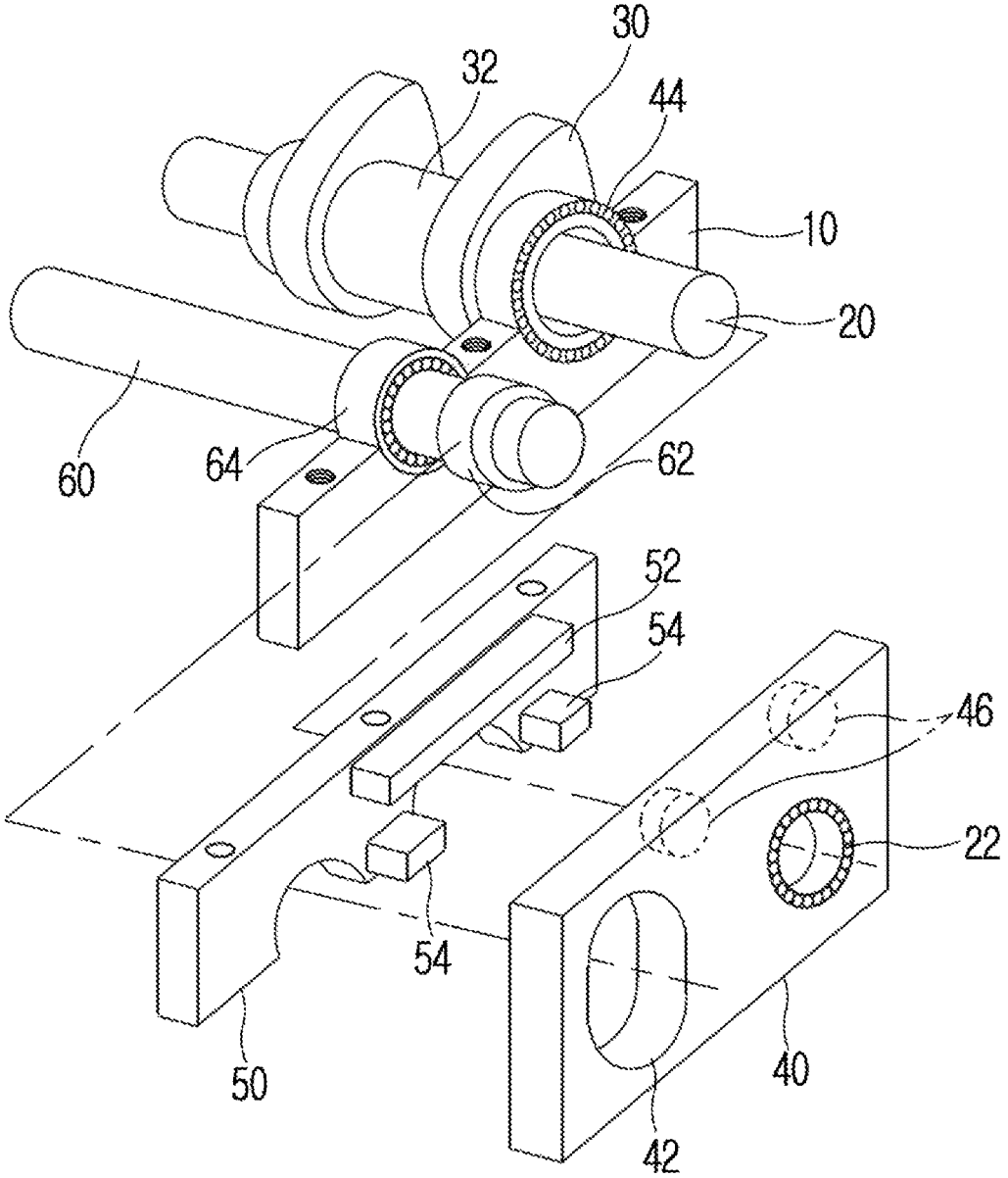
FIG. 1 is an exploded perspective view of an exemplary continuous variable valve duration apparatus according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification and the claims, unless explicitly described to the contrary, the word "comprise" and variations such as "comprises" or "comprising", will be understood to imply the inclusion of stated elements but not the exclusion of any other elements.

FIG. 1 is an exploded perspective view of an exemplary continuous variable valve duration apparatus according to the present invention, and FIG. 2 is a drawing showing operations of the continuous variable valve duration apparatus according to the present invention.

Referring to FIG. 1 and FIG. 2, a continuous variable valve duration apparatus according to an exemplary embodiment of the present invention includes a cam 30 rotatably mounted to a cam carrier 10, a camshaft 20 which is disposed within the cam 30 and relatively rotatable with respect to the cam 30, and of which a rotation center thereof is variable with respect to a rotation center of the cam 30, a connecting link (referring to 70 of FIG. 3) which is disposed between the cam 30 and the camshaft 20, is pivotally connected to at least one of the cam 30 and the camshaft 20, and transmits rotation of the camshaft 20 to the cam 30, and a control portion which selectively changes the rotation center of the camshaft 20.

Structure and function of the connecting link will be described later.

The control portion includes a guide plate 50, and a control plate 40 including a camshaft bearing 22 of which the camshaft 20 is rotatably connected thereto. The control plate 40 may selectively move along the guide plate 50.

A cam support 32 is formed to the cam 30 as a cylinder and the guide plate 50 is connected to the cam carrier 10, and the cam support 32 is connected between the cam carrier 10 and the guide plate 50 through a cam bearing 44.

A guide pin 46 may be formed to one of the control plate 40 and the guide plate 50, and a guide rail 52 or 54 guiding the guide pin 46 may be formed to the other one of the control plate and the guide plate.

In the drawings, the guide pin 46 is protruded from the control plate 40, and a plurality of the guide rails 52 and 54 are formed to the guide plate 50, but it is not limited thereto. On the contrary, the guide pin 46 may be protruded from the guide plate 50, and a plurality of the guide rails 52 and 54 may be formed to the control plate 40. And also, one guide rail 52 or 54 may be formed to guide the guide pin 46.

The camshaft 20 is rotatably disposed on the control plate 40 through the camshaft bearing 22, and the cam 30 is rotatably disposed on the guide plate 50 through the cam support 32 and the cam bearing 44. When the control plate 40 moves guided by the guide plate 50, relative rotation center of the camshaft 20 with respect to the rotation center of the cam 30 is changed to change relative rotation speed of the cam 30 with respect to the rotation speed of the camshaft 20.

The control portion is parallel to the camshaft 20, and further includes a control shaft 60, and an eccentric cam 62 provided thereto. A control slot 42 is formed on the control plate 40 where the eccentric cam 62 is inserted, and a relative position of the control plate 40 with respect to the position of the guide plate 50 is variable according to the rotation position of the control shaft 60.

The guide plate 50 is connected to the cam carrier 10, and the control shaft 60 is mounted between the guide plate 50 and the cam carrier 10 through a control shaft bearing 64.

Hereinafter, referring to FIG. 1 and FIG. 2, operations of the exemplary continuous variable valve duration apparatus according to the present invention will be described.

Figure 2A:
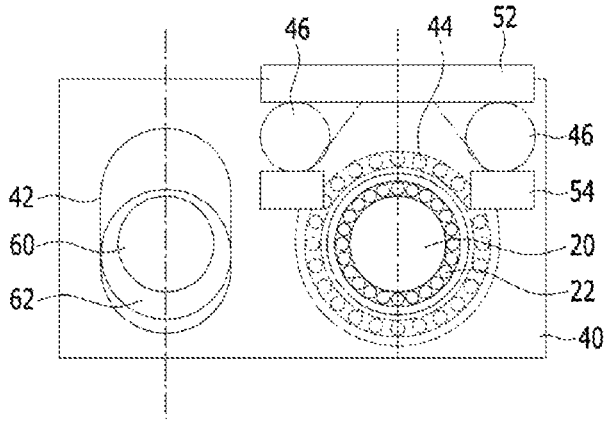
FIG. 2A, FIG. 2B, and FIG. 2C are drawings showing operations of the exemplary continuous variable valve duration apparatus according to the present invention.

As shown in FIG. 2A, at a normal condition (relative position change between the rotation centers of the camshaft 20 and the cam 30 has not occurred), the cam 30 rotates with same phase angle as that of the camshaft 20, and valve duration is not changed.

Figure 2B:
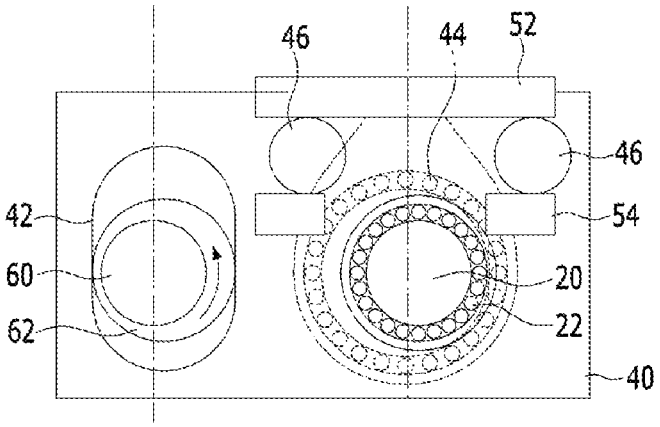

As shown in FIG. 2B, when the control shaft 60 rotates to move the control plate 40 to the right direction of the drawing, the relative position between the rotation centers of the camshaft 20 and the cam 30 is changed. And due to the connecting link 70, which will be described later, the cam 30 rotates with various rotation speeds to realize valve duration change, for example to realize long duration.

Figure 2C:
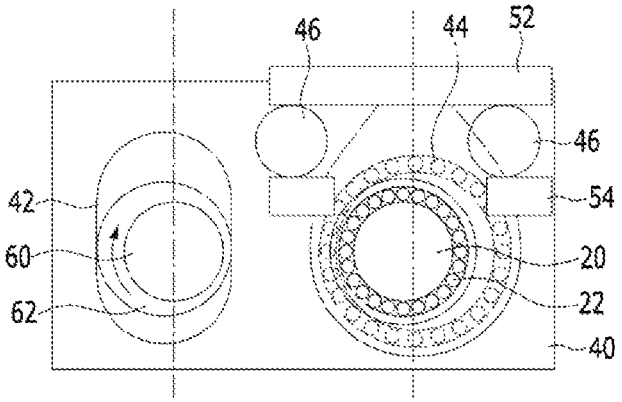

As shown in FIG. 2C, when the control shaft 60 rotates to move the control plate 40 to the left direction of the drawing, the relative position between the rotation centers of the camshaft 20 and the cam 30 is changed. And due to the connecting link 70, which will be described later, the cam 30 rotates with various rotation speeds to realize valve duration change, for example to realize short duration.

Figure 3:
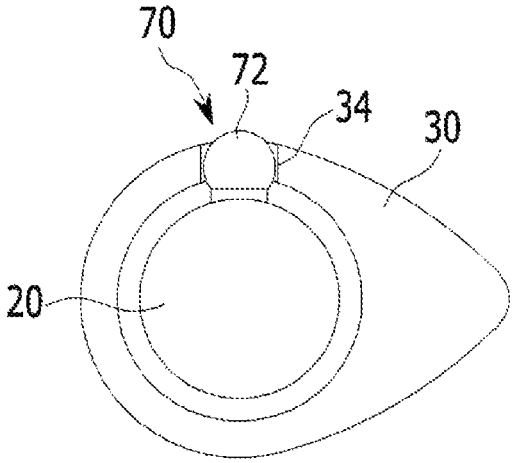
FIG. 3 is a drawing showing an exemplary connecting link applied to the exemplary continuous variable valve duration apparatus according to the present invention.

FIG. 3 a drawing showing an exemplary connecting link applied to the exemplary continuous variable valve duration apparatus according to the present invention.

Referring to FIG. 3, a guide hole 34 is formed on the cam 30, and one end of the connecting link 70 is fixed to the camshaft 20, and a pivot head 72 is formed on the other end of the connecting link 70, and the pivot head 72 is pivotally and slidably inserted into the guide hole 34.

During the rotation of the camshaft 20, the cam 30 rotates with the connecting link 70. Because the pivot head 72 is pivotally and slidably inserted into the guide hole 34, the rotation speed of the cam 30 is variable when relative distance between the rotation centers of the camshaft 20 and the cam 30 is changed from at a predetermined distance. That is, the valve duration is changed.

Figure 4:
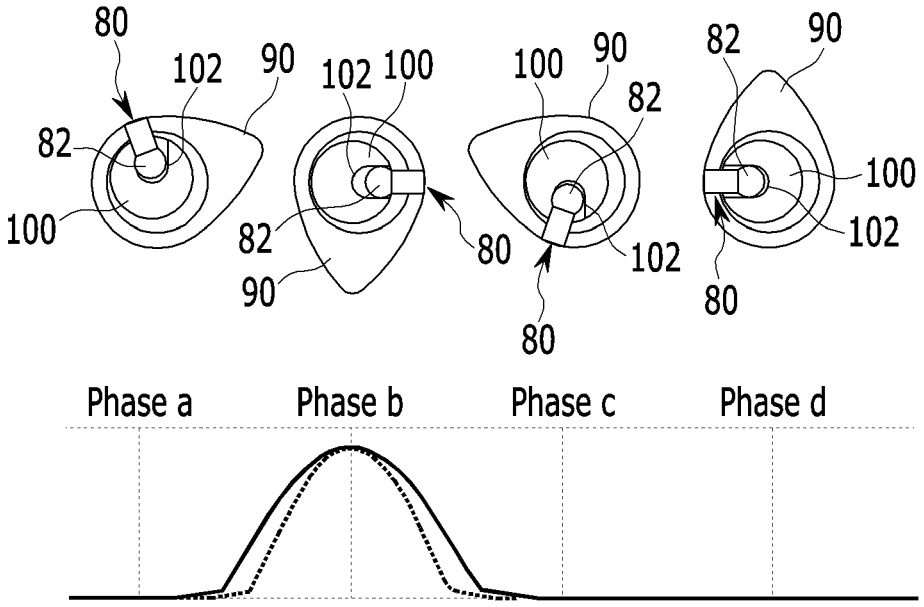
FIG. 4 is a drawing showing valve duration change according to an operation of an exemplary continuous variable valve duration apparatus according to the present invention.

FIG. 4 is a drawing showing valve duration change according to an operation of an exemplary continuous variable valve duration apparatus according to the present invention.

Referring to FIG. 4, a guide hole 102 is formed on a camshaft 100, and one end of a connecting link 80 is fixed to a cam 90, and a pivot head 82 is formed to the other end of the connecting link 80, and the pivot head 82 is pivotally and slidably inserted into the guide hole 102.

As shown in FIG. 4, when relative distance between the rotation centers of the camshaft 100 and the cam 90 is changed, while the rotation speed of the camshaft 100 is constant, the rotation speed of the cam 90 is variable.

From phase a to phase d of FIG. 4, while the phase angle of the camshaft 100 is changed at 90 degrees, the rotation speed of the cam 90 is relatively faster than rotation speed of the camshaft 100 from phase a to phase b and from phase b to phase c, then the rotation speed of the cam 90 is relatively slower than rotation speed of the camshaft 100 from phase c to phase d and from phase d to phase a. That is, the valve duration is changed.

That is, while a general valve profile is realized as shown by the solid line, however, at a short duration mode, the valve duration is changed as shown by the dotted line.

Figure 5:
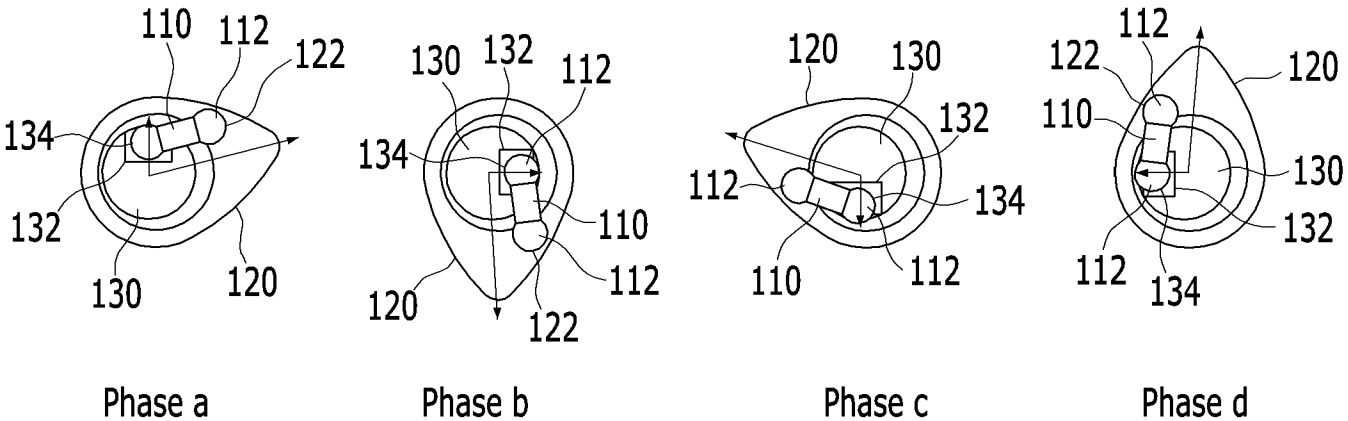
FIG. 5 and FIG. 6 are drawings showing various connecting links applied to the exemplary continuous variable valve duration apparatus according to the present invention.
Figure 6:
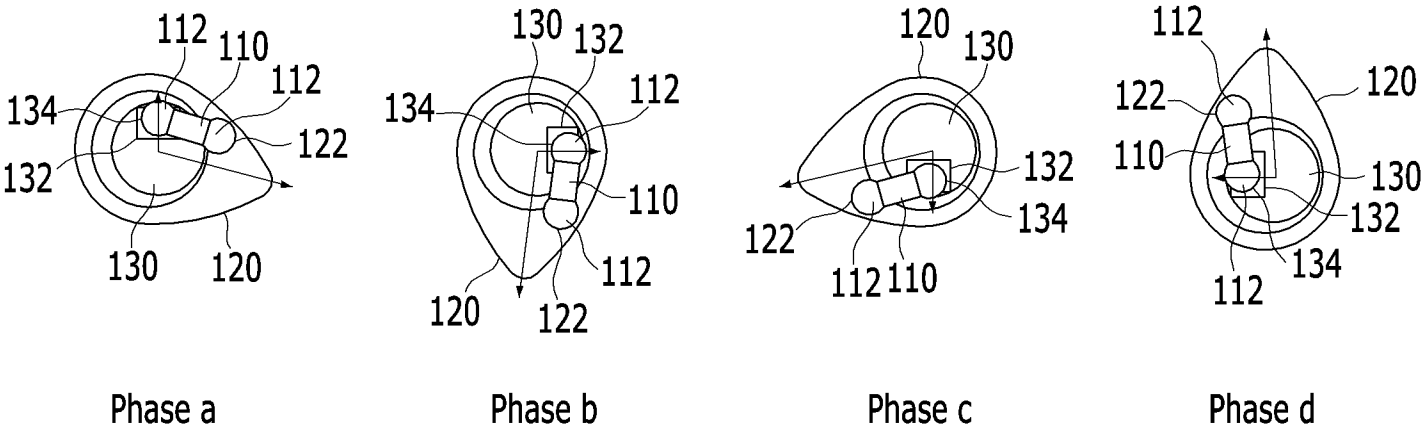

FIG. 5 and FIG. 6 are drawings showing various connecting links applied to an exemplary continuous variable valve duration apparatus according to the present invention.

Referring to FIG. 5 and FIG. 6, pivot holes 134 and 122 are formed on a camshaft 130 and a cam 120 respectively, and pivot heads 112 are formed on both ends of a connecting link 110 and are pivotally inserted into the pivot holes 134 and 122 respectively.

A process for forming the pivot holes to the camshaft 130 may not be easily performed, and thus a pivot cap 132 where the pivot hole 134 is formed thereto may be connected to the camshaft 130 for easy manufacturing and the pivot head 112 may be inserted into the pivot holes 134 and 122 respectively.

As shown in FIG. 5, the relative rotation speed of the cam 120 is faster than the rotation speed of the camshaft 130 from phase a to phase b and from phase b to phase c, and then the relative rotation speed of the cam 120 is slower than the rotation speed of the camshaft 130 from phase c to phase d and from phase d to phase a according to the relative position of the camshaft 130 and the cam 120, so that the short duration is realized.

As shown in FIG. 6, the relative rotation speed of the cam 120 is slower than the rotation speed of the camshaft 130 from phase a to phase b and from phase b to phase c, and then the relative rotation speed of the cam 120 is faster than the rotation speed of the camshaft 130 from phase c to phase d and from phase d to phase a according to the relative position of the camshaft 130 and the cam 120, so that the long duration is realized.

Figure 7:
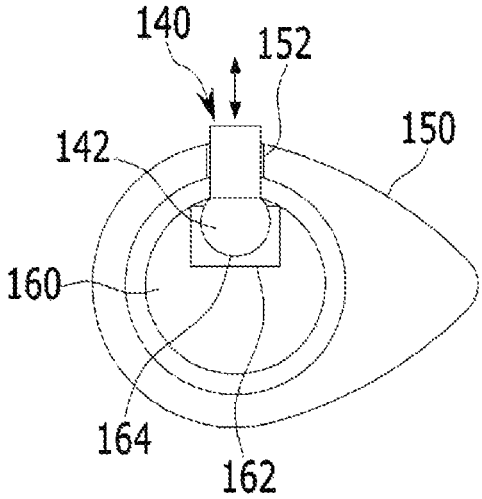
FIG. 7 and FIG. 8 are drawings showing various connecting links applied to the exemplary continuous variable valve duration apparatus according to the present invention.
Figure 8:
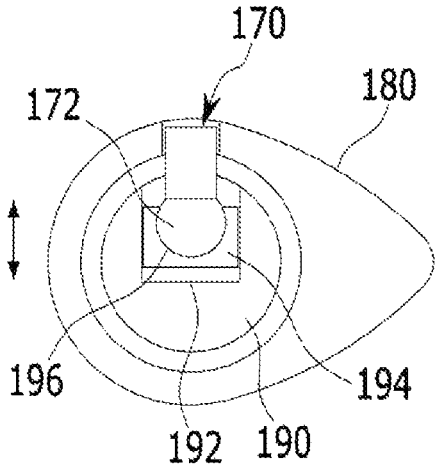

FIG. 7 and FIG. 8 are drawings showing various connecting link applied to an exemplary continuous variable valve duration apparatus according to the present invention.

As shown in FIG. 7, a guide slot 152 is formed on a cam 150, a pivot hole 164 is formed to a camshaft 160, and one end of a connecting link 140 is slidably inserted into the guide slot 152, and a pivot head 142 is formed to the other end of the connecting link 140, and the pivot head 142 is pivotally inserted into the pivot hole 164.

A process for forming the pivot hole to the camshaft 160 may not be easily performed, and thus a pivot cap 162 where the pivot hole 164 is formed may be connected to the camshaft 160 for easy manufacturing and the pivot head 142 may be inserted into the pivot hole 164.

As shown in FIG. 8, a guide slot 192 may be formed to a camshaft 190, a pivot cap 194, where a pivot hole 196 is formed thereto, may be slidably inserted into the guide slot 192, and one end of a connecting link 170 may be fixed to a cam 180, and a pivot head 172 may be formed to the other end of the connecting link 170, and the pivot head 172 may be pivotally inserted into the pivot hole 196.

The connecting link 140 and 170 as shown in FIG. 7 and FIG. 8 may be slidably and/or pivotally connected to the cams 150 and 180 and the camshafts 160 and 190 respectively, thus relative rotation speed of the cams 150 and 180 with respect to the camshafts 160 and 190 may be variable. So the valve duration may be variable according to the changing of relative rotation centers between the camshafts 160 and 190 and the cams 150 and 180.

As described above, the exemplary continuous variable valve duration apparatus according to the present invention may change the valve duration using the simple connecting link to enhance fuel consumption efficiency and performance of an engine.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a cam rotatably mounted on a cam carrier;

a camshaft disposed within the cam and relatively rotatable with respect to the cam, wherein a rotation center of the camshaft is variable with respect to a rotation center of the cam;

a connecting link disposed between and connected to both of the cam and the camshaft, at least one end of the connecting link being pivotally connected to at least one of the cam and the camshaft, wherein the connecting link transmits rotation of the camshaft to the cam; and a controller selectively changing the rotation center of the camshaft.

2. The continuous variable valve duration apparatus of claim 1, wherein the controller comprises:

a guide plate; and a control plate including a camshaft bearing to which the camshaft is rotatably connected, wherein the control plate selectively moves along the guide plate.

3. The continuous variable valve duration apparatus of claim 2, wherein a cam support is formed to the cam on the camshaft in the form of a cylinder, the guide plate is connected to the cam carrier, and the cam support is connected between the cam carrier and the guide plate through a cam bearing.

4. The continuous variable valve duration apparatus of claim 3, wherein a guide pin is formed on either of the control plate or the guide plate; and wherein a guide rail guiding the guide pin is formed on either of the control plate or the guide plate on which the guide pin is not formed.

5. The continuous variable valve duration apparatus of claim 2, wherein the controller further includes a control shaft which is parallel to the camshaft and an eccentric cam mounted to the control shaft, wherein a control slot is formed on the control plate for the eccentric cam to be inserted thereto and engaged therein, and wherein a relative position of the control plate with respect to a position of the guide plate is changeable according to rotation of the control shaft.

6. The continuous variable valve duration apparatus of claim 5, wherein the guide plate is connected to the cam carrier, and the control shaft is mounted between the guide plate and the cam carrier through a control shaft bearing.

7. The continuous variable valve duration apparatus of claim 1, wherein a guide hole is formed on the cam, wherein a first end of the connecting link is fixed to the camshaft, and a pivot head is formed on a second end of the connecting link, and the pivot head is pivotally and slidably inserted into the guide hole.

8. The continuous variable valve duration apparatus of claim 1, wherein a guide hole is formed on the camshaft, and wherein a first end of the connecting link is fixed to the cam, and a pivot head is formed on a second end of the connecting link, and the pivot head is pivotally and slidably inserted into the guide hole.

9. The continuous variable valve duration apparatus of claim 1, wherein pivot holes are formed on the camshaft and the cam respectively, and pivot heads are formed on both ends of the connecting link and each pivot head is pivotally inserted into corresponding pivot holes.

10. The continuous variable valve duration apparatus of claim 1, wherein a pivot hole is formed on the cam, a pivot cap, on which a pivot hole is formed, is connected to the camshaft, and pivot heads are formed on both ends of the connecting link and each pivot head is pivotally inserted into corresponding pivot holes.

11. The continuous variable valve duration apparatus of claim 1, wherein a guide slot is formed on the cam, wherein a pivot hole is formed on the camshaft, and wherein a first end of the connecting link is slidably inserted into the guide slot, and a pivot head is formed on a second end of the connecting link, and the pivot head is pivotally inserted into the pivot hole.

12. The continuous variable valve duration apparatus of claim 1, wherein a guide slot is formed on the cam, wherein a pivot cap, on which a pivot hole is formed is connected to the camshaft, and wherein a first end of the connecting link is slidably inserted into the guide slot, and a pivot head is formed on a second end of the connecting link, and the pivot head is pivotally inserted into the pivot hole.

13. The continuous variable valve duration apparatus of claim 1, wherein a guide slot is formed on the camshaft, wherein a pivot cap, on which a pivot hole is formed is slidably inserted into the guide slot, and wherein a first end of the connecting link is fixed to the cam, and a pivot head is formed on a second end of the connecting link, and the pivot head is pivotally inserted into the pivot hole.

* * * * *